US007665864B2

(12) United States Patent
Zheng et al.

(10) Patent No.: US 7,665,864 B2
(45) Date of Patent: Feb. 23, 2010

(54) LED LAMP ASSEMBLY

(75) Inventors: Shi-Song Zheng, Shenzhen (CN); Li He, Shenzhen (CN); Sai-Wen Wang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 27 days.

(21) Appl. No.: 12/051,856

(22) Filed: Mar. 20, 2008

(65) Prior Publication Data

US 2009/0237927 A1 Sep. 24, 2009

(51) Int. Cl.
*F21V 21/00* (2006.01)

(52) U.S. Cl. ..... 362/249.11; 362/294; 362/373

(58) Field of Classification Search ..... 362/249.01, 362/249.02, 249.11, 294, 373, 430, 431
See application file for complete search history.

(56) References Cited

U.S. PATENT DOCUMENTS

| | | | | |
|---|---|---|---|---|
| 6,860,619 | B2 * | 3/2005 | Swanson | 362/249.11 |
| 7,488,093 | B1 * | 2/2009 | Huang et al. | 362/294 |
| 2008/0043479 | A1 * | 2/2008 | Wang | 362/373 |

* cited by examiner

*Primary Examiner*—John A Ward
(74) *Attorney, Agent, or Firm*—Frank R. Niranjan

(57) ABSTRACT

An LED lamp assembly includes a central member and a plurality of lamps each having an LED module and a heat sink in thermal connection with the LED module. The central member has a plurality of inserting extrusions formed at a circumference thereof. The lamps each have a receiving tube projecting from an end thereof. The inserting extrusions are respectively inserted into the receiving tubes of the lamps to assemble the lamps onto the circumference of the central member. The lamps are tilted from the central portion along a radially outward direction.

18 Claims, 5 Drawing Sheets

LED LAMP ASSEMBLY

BACKGROUND OF THE INVENTION

1. Field of the Invention

The present invention relates to an LED lamp assembly for a lighting purpose, and more particularly relates to an improved LED lamp assembly having a versatile use, good heat dissipation capability and large illumination area.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

Besides, since the LEDs are generally arranged on a printed circuit board which having a flattened surface, the LEDs acting as a light source and arranged in this way usually are failed to provide a three-dimensional lamplight that suitable for a condition that needs even and large-scale light.

What is needed, therefore, is an improved LED lamp assembly which can overcome the above problems.

SUMMARY OF THE INVENTION

An LED lamp assembly includes a central member and a plurality of lamps. The central member has a plurality of inserting extrusions formed at a circumference thereof. The lamps each have a receiving tube projecting from an end thereof. The inserting extrusions are respectively inserted into the receiving tubes of the lamps to assemble the lamps onto the circumference of the central member. In a first embodiment, the lamps are tilted upwardly from the central member along a radially outward direction. The lamp has an LED module received therein and a heat sink over and in thermal connection with the LED module. The LED modules face downwardly. Fins of the heat sinks extend upwardly. In a second embodiment, the LED lamp assembly is used as a suspension lamp. The lamps are tilted downwardly from the central member along the radially outward direction. The LED modules are located over the heat sinks and face upwardly. The fins of the heat sinks extend downwardly. In both embodiments, a rectifier is received in the central member and thermally connects with the central member. The central member has a plurality of radial fins. In the first embodiment, the radial fins face upwardly. In the second embodiment, the radial fins face downwardly.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
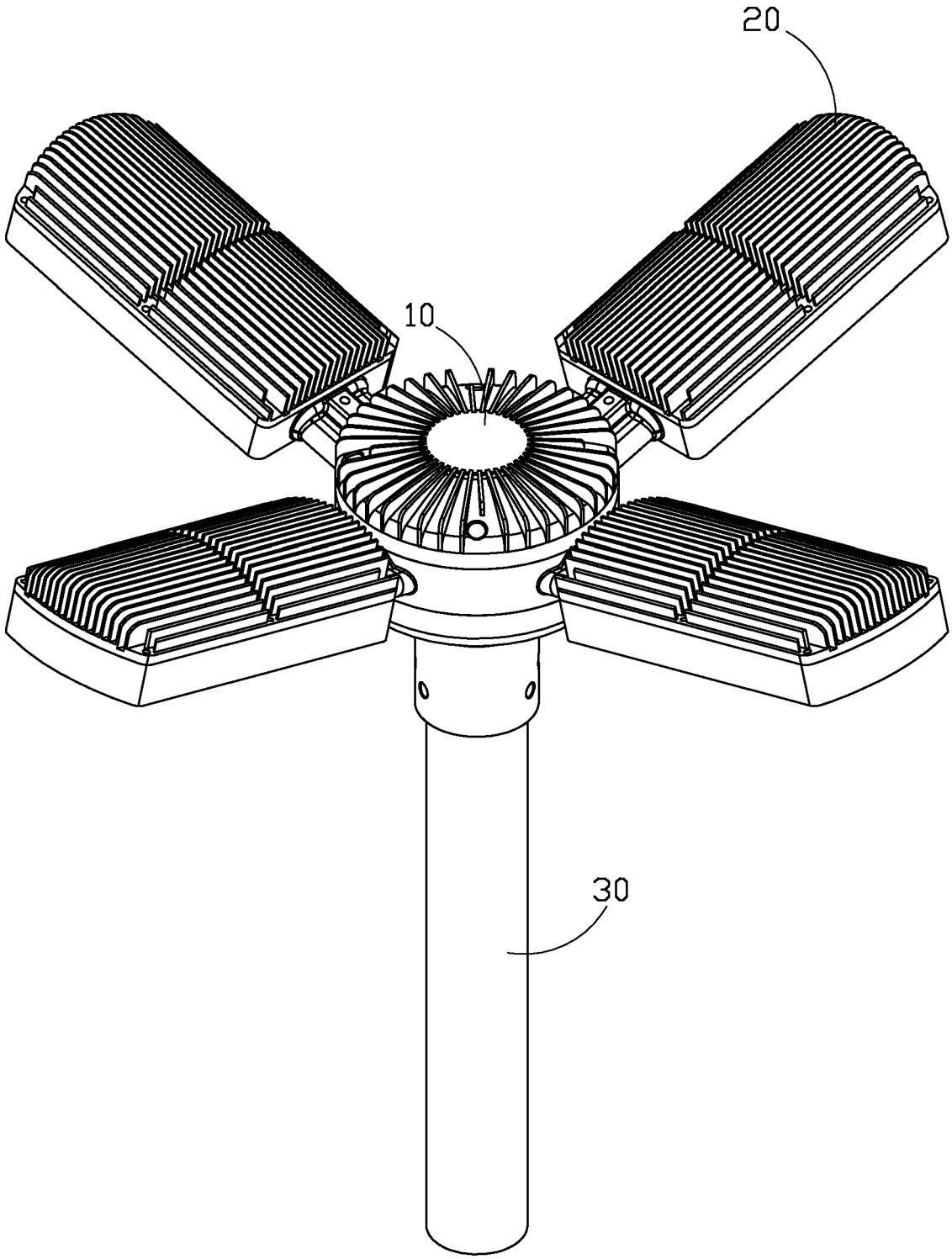
FIG. 1 is an isometric, assembled view of an LED lamp assembly in accordance with a first preferred embodiment of the present invention.
Figure 2:
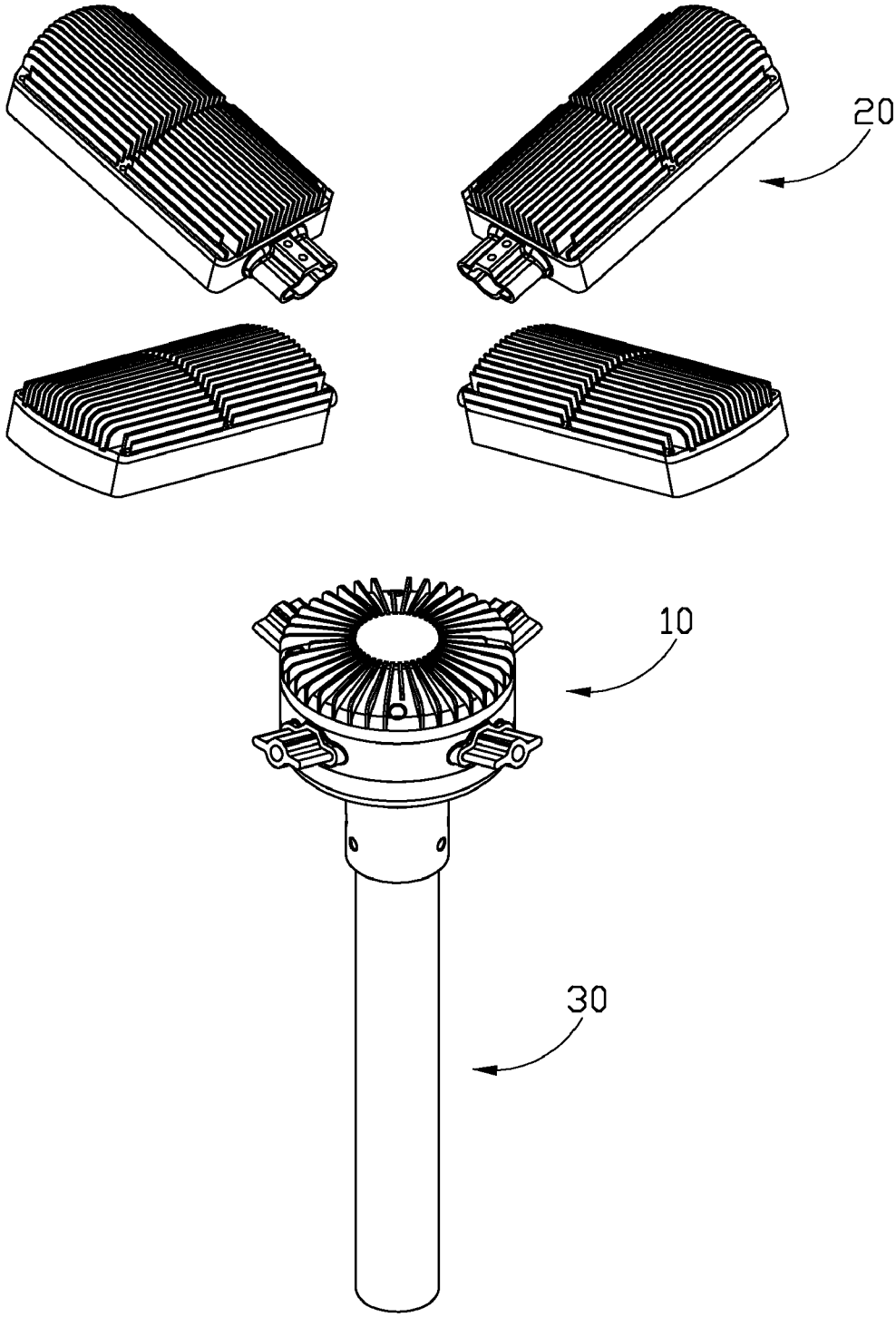
FIG. 2 is an exploded view of FIG. 1.

Referring to FIGS. 1-2, an LED lamp assembly in accordance with a first preferred embodiment is illustrated. The LED lamp assembly comprises a central member 10 and four lamps 20 evenly attached to a circumference of the central member 10. The LED lamp assembly can be held at a predetermined position by a supporting post 30 engaging with the central member 10. In this embodiment, the supporting post 30 extends upwardly to support the lamps 20.

Figure 3:
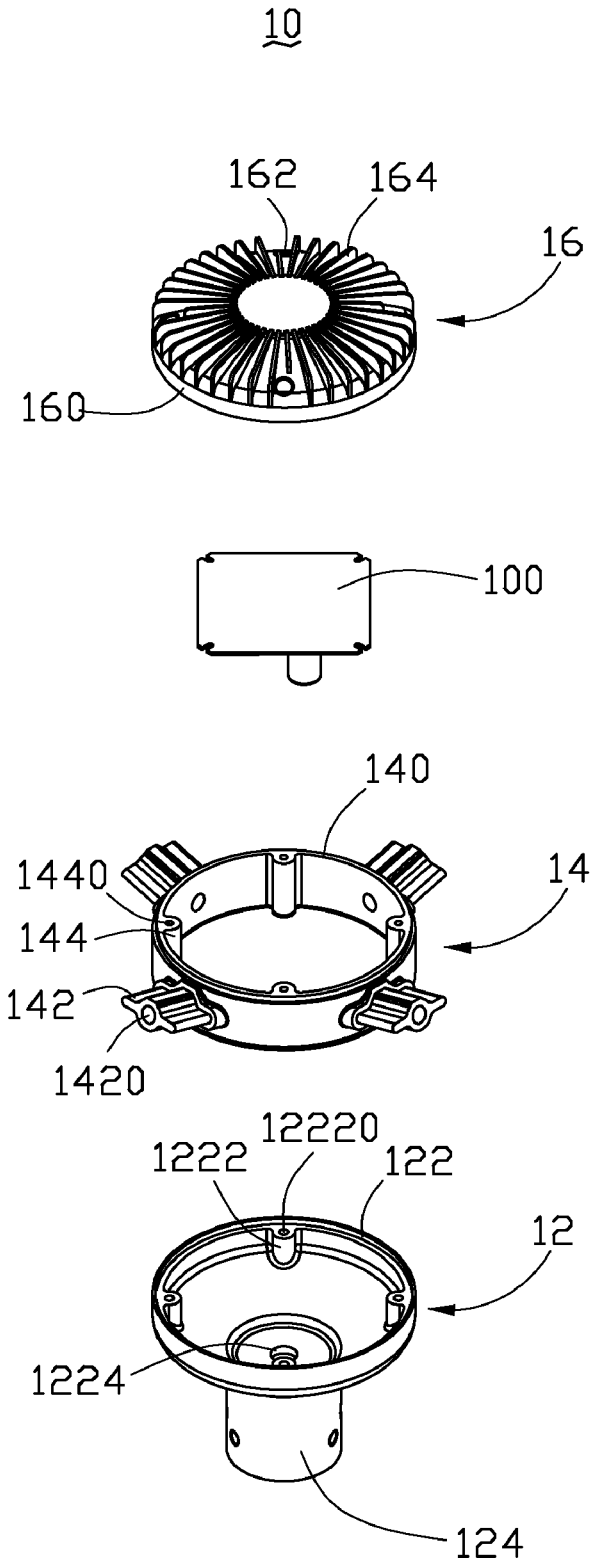
FIG. 3 is an exploded view of a central member of the LED lamp assembly in FIG. 2.

Particularly referring to FIG. 3, the central member 10 comprises a base 12, a top cover 16 and a connecting part 14 sandwiched between and interconnecting the base 12 and the top cover 16. The base 12 has a bowl-shaped body 122 and a sleeve 124 extending downwardly from a central portion of a bottom of the bowl-shaped body 122. The bowl-shaped body 122 is provided with four vertical fixing protrusions 1222 evenly located at inner side of a sidewall thereof. Each of the fixing protrusions 1222 defines a through hole 12220 therein. Each of the through holes 12220 is provided for upward extension of a screw (not shown) therethrough to screw into the connecting part 14 to securely couple the base 12 and the connecting part 14 together. The bowl-shaped body 122 in a centre of the bottom thereof defines a bore 1224 communicating with the sleeve 124 for lead wires (not shown) to extend upwards therethrough to electrically connect with the lamps 20. The sleeve 124 is configured to receive the supporting post 30 therein and defines a plurality of locking holes 1240 in a circumferential sidewall thereof. The locking holes 1240 are provided for allowing a plurality of bolts (not shown) inserted therein to securely lock the base 12 to the supporting post 30.

The connecting part 14 is integrally made of a metal with good heat conductivity such as copper and aluminum and is configured for assembling all members of the LED lamp assembly together. The connecting part 14 comprises a tube-shaped sidewall 140 and four inserting extrusions 142 extending outwardly and symmetrically from an outer side of the sidewall 140. The sidewall 140 has a caliber identical to that of the bowl-shaped body 12. Corresponding to the four fixing protrusions 1222 of the base 12, the sidewall 140 is provided four engaging protrusions 144 symmetrically located in an inner side thereof. Each of the engaging protrusions 144 defines an engaging hole 1440 therein for threadedly receiving the screw (not shown) which extends upwardly through the base 12 and a screw (not shown) which extends downwards through the top cover 16. Each of the inserting extrusions 142 is configured to secure one of the lamps 20 and can have different configurations in different embodiments. In this embodiment, each of the inserting extrusions 142 is configured to have a central rod (not labeled) and two plate-shaped shoulders (not labeled) connecting with two opposite lateral sides of the central rod. The two shoulders are in the same level with each other. The inserting extrusions 142 are centrosymmetrical to each other relative to an axis of the tube-shaped sidewall 140. Each of the inserting extrusions 142 is slightly upwardly slantwise to the sidewall 140 and defines an extending hole 1420 in the central portion thereof for the lead wires to extend therethrough to electrically connect with the lamps 20.

The top cover 16 is integrally made of a metal block with good heat conductivity such as copper and aluminum, and has a circular top plate 160 covering on a top of the connecting part 14 and a plurality of fins 164 arranged on a top surface of the top plate 160. The top plate 160 has a diameter similar to the caliber of the tube-shaped sidewall 140 of the connecting part 14 and defines four mounting holes 162 adjacent to a rim thereof. The mounting holes 162 are corresponding to the engaging holes 1440 of the connecting part 14 for allowing screws (not shown) to extend through the mounting holes 162 to engage into the engaging holes 1440 of the connecting part 14. The fins 164 are perpendicular to the top plate 160 and extend outwardly and radially from a circular central portion of the top plate 160.

In assembly of the central member 10, the base 12, the connecting part 14 and the top cover 16 are assembled together by the screws. A rectifier 100 is hermetically received in the connecting part 14. Heat generated by the rectifier 100 is absorbed by the top plate 160 and then dissipated into air via the fins 164 of the top cover 16.

Figure 4:
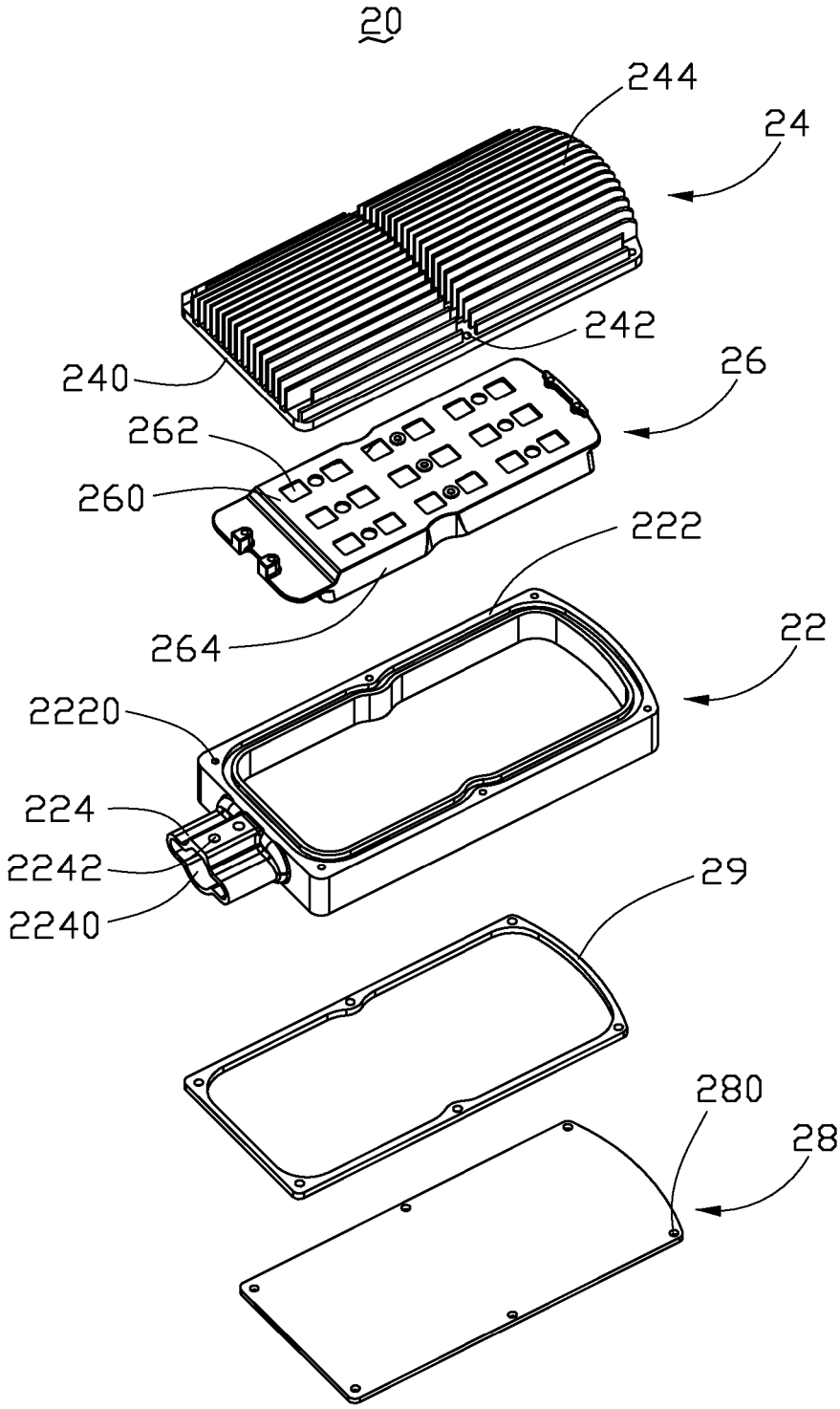
FIG. 4 is an exploded view of a lamp of the LED lamp assembly in FIG. 2.

As shown in FIG. 4, the lamp 20 comprises a supporting frame 22, a heat sink 24 covering on a top of the supporting frame 22, a light-emitting diode (LED) module 26 attached to a bottom surface of the heat sink 24 and accommodated in the supporting frame 22, a transparent/translucent cover 28 attached to a bottom of the supporting frame 22 and a rectangular, ring-shaped seal 29 sandwiched between the bottom of the supporting frame 22 and the cover 28 for preventing rainwater or dust from creeping into a space defined by the supporting frame 22 to cause the LED module 26 to have short circuit or contaminate the LED module 26. The supporting frame 22 is integrally made of a metal block with good heat conductivity such as copper and aluminum, and comprises a rectangular frame part 222 and an engaging tube 224 extending horizontally from a lateral side of the frame part 222. The frame part 222 consists of a pair of parallel long beams (not labeled) and a pair of parallel short beams (not labeled) connected together. Each of the long beams in a top and bottom surface thereof defines a plurality of engaging orifices 2220 (also referring to FIG. 5) respectively located at middle and two opposite ends thereof. The engaging orifices 2220 are configured for engaging with screws (not shown) that extend through the heat sink 24 and the cover 28 to couple the heat sink 24 and the cover 28 respectively to the top and the bottom of the supporting frame 22. The frame part 22 defines a receiving groove 2222 in the bottom thereof along the beams for receiving the seal 29. The engaging tube 224 extends outwardly and perpendicularly from a middle of one of the short beam. A hollow hole 2240 is formed in the engaging tube 224 for receiving one of the inserting extrusions 142 of the central member 10 therein. Two locking orifices 2242 are defined in a top of the engaging tube 224 for allowing bolts (not shown) inserted therein to lock the engaging tube 224 with the inserting extrusion 142 of the central member 10.

The heat sink 24 integrally is made of a metal block with good heat conductivity such as copper and aluminum, and comprises a covering plate 240 and a plurality of fins 244 arranged on the covering plate 240. The covering plate 240 is rectangular and has a configuration that it can appropriately cover the top of the supporting frame 22. Corresponding to the engaging orifices 2220 in the top of the supporting frame 22, a plurality of through orifices 242 are provided in the covering plate 240 for allowing screws (not shown) to extend therethrough to screw into the engaging orifices 2220. The fins 244 are apart from each other, parallel to two opposite long sides of the covering plate 240 and have heights decreased gradually from a middle toward the two opposite long sides of the covering plate 240.

The LED module 26 is attached to a bottom surface of the covering plate 240 of the heat sink 24 and enclosed by the frame part 222. The LED module 26 comprises a rectangular circuit board 260, a plurality of LEDs 262 mounted on the circuit board 260 and a reflecting flange 264 extending downwardly and obliquely from a periphery of the printed circuit board 260 to surround the LEDs 262.

The cover 28 is made of transparent/translucent plastic or glass and in the form of a rectangular plate. The cover 28 defines therein a plurality of through orifices 280 for allowing screws (not shown) to extend therethrough to screw into the engaging orifices 2220 in the bottom of the supporting frame 22 to thereby couple the cover 28 to the bottom of the supporting frame 22. The seal 29 is received in the receiving groove 2222 of the supporting frame 22 and is pressed upwardly by the cover 28.

In assembly of the lamp 20, the heat sink 24 and the cover 28 are coupled respectively to the top and bottom of the supporting frame 22 by the screws, thereby hermetically enclosing the LED module 26 in the lamp 20.

In use of the LED lamp assembly, the four lamps 20 are assembled to the circumference of the central member 10 by the fours inserting extrusions 142 of the central member 10 being respectively inserted into the four engaging tubes 224 of the four lamps 20. The LED lamp assembly is supported by the supporting post 30 with the LED modules 26 of the lamps 20 facing downwardly toward ground. At this embodiment, the lamps 20 are tilted upwardly from the central member 10 along a radially outward direction. As the lamps 20 are disposed surrounding the central member 10, every sides of the LED lamp assembly are sufficiently illuminated, whereby the LED lamp assembly can provide a large illumination area. When the LED module 26 is activated to generate light, a mass of heat generated by the LEDs 262 is simultaneously absorbed by the cover plate 240 of the heat sink 24 to be dissipated into the air via the fins 244, whereby the LED module 20 is cooled duly and timely, and the LEDs 22 can thus function normally. In this embodiment, the fins 244 face upwardly.

Figure 5:
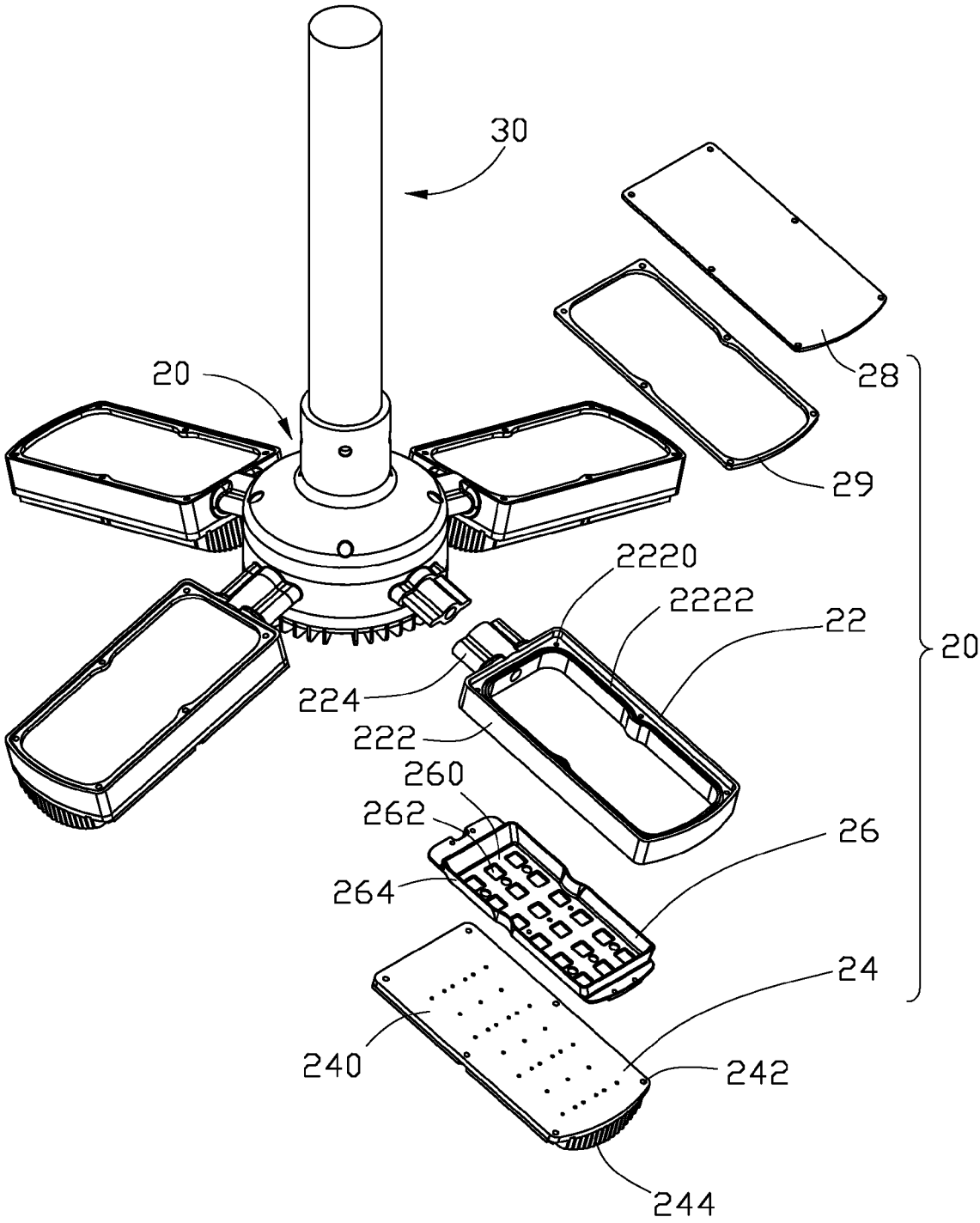
FIG. 5 is an exploded view of an LED lamp assembly in accordance with a second preferred embodiment of the present invention.

As shown in FIG. 5, an LED lamp assembly in accordance with a second preferred embodiment is illustrated. The difference between the second and first embodiments is that the second embodiment has a different orientation. The components for constructing the second embodiment are the same as those for the first embodiment. The second embodiment is used as a suspension lamp. The central member 10 is connected to a bottom end of the supporting post 30. The LED modules 26 face upwardly toward the sky and the top cover 16 of the central member 10 is oriented toward the ground. The fins 164, 244 face downwardly. In the second embodiment, the lamps 20 are titled downwardly from the central member 10 along a radially outward direction.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly, comprising:

a central member having a plurality of inserting extrusions formed at a circumference thereof;

a plurality of lamps each having a receiving tube projecting from an end thereof;

wherein the inserting extrusions are respectively inserted into the receiving tubes of the lamps to assemble the lamps onto the circumference of the central member, each lamp having an LED module therein, the lamps being tilted from the central member along a radially outward direction;

wherein the central member comprises a base, a top cover and a connecting part sandwiched between and interconnecting the base and the top cover; and wherein the base has a bowl-shaped body and a sleeve extending from a central portion of the bowl-shaped body, and the sleeve securely receives a supporting post to hold the LED lamp assembly in position.

2. The LED lamp assembly as claimed in claim 1, wherein each of the inserting extrusions has a central rod and two plate-shaped shoulders that are connected to two opposite lateral sides of the central rod, the shoulders being in the same level with each other.

3. The LED lamp assembly as claimed in claim 1, wherein the connecting part comprises a tube-shaped sidewall, and the inserting extrusions are formed on a circumference of the sidewall.

4. The LED lamp assembly as claimed in claim 1, wherein the top cover comprises a circular top plate covering an opening of the connecting part and a plurality of fins formed on top plate.

5. The LED lamp assembly as claimed in claim 4, wherein the fins are perpendicular to the top plate and extend outwardly and radially from a circular central portion of the top plate.

6. The LED lamp assembly as claimed in claim 1, wherein the lamp comprises a supporting frame, a heat sink covering an opening of the supporting frame, the LED module being attached to the heat sink and accommodated in the supporting frame.

7. The LED lamp assembly as claimed in claim 6, wherein the supporting frame comprises a rectangular frame part having a pair of parallel long beams and a pair of parallel short beams, and the receiving tube is projected from an outer side of one of the short beams.

8. The LED lamp assembly as claimed in claim 7, wherein the heat sink comprises a covering plate covering an opening of the frame part and a plurality of fins arranged on the covering plate.

9. The LED lamp assembly as claimed in claim 8, wherein the fins are apart from each other and parallel to two opposite long sides of the covering plate and have heights decreased gradually from a middle toward the two opposite long sides of the covering plate.

10. The LED lamp assembly as claimed in claim 6, wherein the LED module comprises a rectangular circuit board, a plurality of LEDs mounted on the circuit board and a reflecting flange extending from the circuit board and surrounding the LEDs.

11. The LED lamp assembly as claimed in claim 6, wherein the lamp further comprises a cover opposite the heat sink and covering the opening of the supporting frame.

12. The LED lamp assembly as claimed in claim 11, wherein the frame is further provided with a seal sandwiched between the supporting frame and the cover.

13. The LED lamp assembly as claimed in claim 12, wherein a receiving groove is formed in the supporting frame for receiving the seal therein.

14. An LED lamp assembly comprising:

a central member receiving an electrical rectifier therein;

a supporting post secured to the central member for holding the LED lamp at a predetermined position; and a plurality of lamps each having an LED module therein and a heat sink in thermal connection with the LED module, the lamps being secured to a periphery of the central member and being tilted from the central member along an outward direction;

wherein each of the lamps comprises a supporting frame, a heat sink covering an opening of the supporting frame, the LED module being attached to the heat sink and accommodated in the supporting frame; and wherein the supporting frame comprises a rectangular frame part having a pair of parallel long beams and a pair of parallel short beams, and a receiving tube is projected from an outer side of one of the short beams and connected to the periphery of the central member.

15. The LED lamp assembly as claimed in claim 14, wherein the lamps are titled upwardly and the LED modules face downwardly, the central member being secured to a top end of the supporting post, the fins facing upwardly.

16. The LED lamp assembly as claimed in claim 15, wherein the central member is formed with fins which are thermally connected with the rectifier, the fins of the central member facing upwardly.

17. The LED lamp assembly as claimed in claim 14, wherein the lamps are titled downwardly and the LED modules face upwardly, the central member being secured to a bottom end of the supporting post, the fins facing downwardly.

18. The LED lamp assembly as claimed in claim 17, wherein the central member is formed with fins which are thermally connected with the rectifier, the fins facing downwardly.

* * * * *